United States Patent [19]

Traa

[11] 3,982,115

[45] Sept. 21, 1976

[54] ELECTRONICALLY PROGRAMMABLE FUNCTION GENERATOR

[75] Inventor: Einar Oddbjorn Traa, Portland, Oreg.

[73] Assignee: Tektronix, Inc., Beaverton, Oreg.

[22] Filed: Jan. 31, 1975

[21] Appl. No.: 545,962

[52] U.S. Cl. ..... 235/197; 307/229

[51] Int. Cl.[2] ..... G06G 7/26

[58] Field of Search ..... 235/197, 150.53, 196, 235/195, 194; 307/229; 328/142

[56] References Cited

UNITED STATES PATENTS

| | | | |
|---|---|---|---|
| 3,209,266 | 9/1965 | White | 235/197 UX |
| 3,244,867 | 4/1966 | Lavin | 235/197 |
| 3,358,130 | 12/1967 | Miura et al. | 235/197 |
| 3,443,082 | 5/1969 | Abe | 235/197 |
| 3,740,539 | 6/1973 | Pace | 235/197 |

*Primary Examiner*—Joseph F. Ruggiero
*Attorney, Agent, or Firm*—Adrian J. LaRue; Kenneth M. Durk

[57] ABSTRACT

An electronically programmable function generator with two dimensional programmability is provided which has an output, a current, which is a piecewise linear function ("transfer curve") of its input, a voltage. The transfer curve consists of contiguous straight line segments and the breakpoints between the line segments are electronically non-interactive and independently programmable. The generator in its preferred embodiment linearizes the response of a non-linear amplifier or can be utilized wherever an empirical non-linear function is needed in an analog system.

4 Claims, 7 Drawing Figures

ELECTRONICALLY PROGRAMMABLE FUNCTION GENERATOR

BACKGROUND OF THE INVENTION

In the electronic art generally, and particularly in the automatic control and instrumentation art, a variety of known electronic function generators accept signals representing values of real or simulated variables and provide outputs therefrom which are arbitrary, sometimes complicated functions of the variable. It is then often convenient to approximate such functions by piecewise - linear approximation. Prior art function generators of this type have included the diode-resistor, digital, and nonlinear resistor methods to accomplish the approximation. However, diode resistor methods require a great number of diodes and associated circuits to obtain the function and the breakpoints are not electronically or independently programmable; digital methods are usually expensive as analog to digital and digital to analog converters must be used with a digital processor (computer); and nonlinear resistor methods rely on the voltage/current characteristic of a non-linear resistor and such a characteristic cannot readily be produced. Other prior art programmable function generators have included current ladders for sequentially actuating a plurality of output transistors such as, for example, the programmable function generator of U.S. Pat. No. 3,740,539. Such schemes usually modulate a standard current which is applied to a resistor network that carries programmed information, hence additional processes.

SUMMARY OF THE INVENTION

According to the present invention, the electronically programmable function generator includes transistor voltage comparators which compare the incoming signal to programmed abscissa points and provides a corresponding ordinate, linearly interpolating between nearest points. Basically, common emitter transistor voltage comparators with off-set long tail resistors are used to generate currents having the same ratio as the ratio of the input difference voltages applied to the comparators, then applying the resultant current ratio to the wideband differential amplifier described in U.S. Pat. No. 3,689,752 to proportion programmed (ordinates) reference currents as to the difference voltages compared.

The generator according to the present invention is well adapted to planar integrated circuit fabrication processes.

It is therefore an object of the present invention to provide an improved transistorized function generator adapted for integrated circuit fabrication.

It is a further object of the present invention to provide an improved transistorized function generator which compares the incoming signal to the programmed abscissa and provides therefrom a corresponding ordinate.

It is yet a further object of the present invention to provide an improved transistorized function generator whereby the output between programmable points is a linear interpolation of the output between the programmable points.

It is another object of the present invention to provide currents having the same ration as the ratios of the incoming voltages.

The foregoing and numerous other objects, advantages, and inherent functions of the present invention will become apparent as the same is more fully understood from the following description which describes the present invention; it is to be understood, however, that these embodiments are not intended to be exhausting nor limiting of the invention, but are given for purposes of illustration in order that others skilled in the art may fully understand the invention and principles thereof and the manner of applying it in actual use so that they may modify it in various forms, each as may best be suited to the conditions of the particular use.

DESCRIPTION OF THE DRAWINGS

In the drawings:

FIG. 3 including

DESCRIPTION OF THE INVENTION

Figure 1:
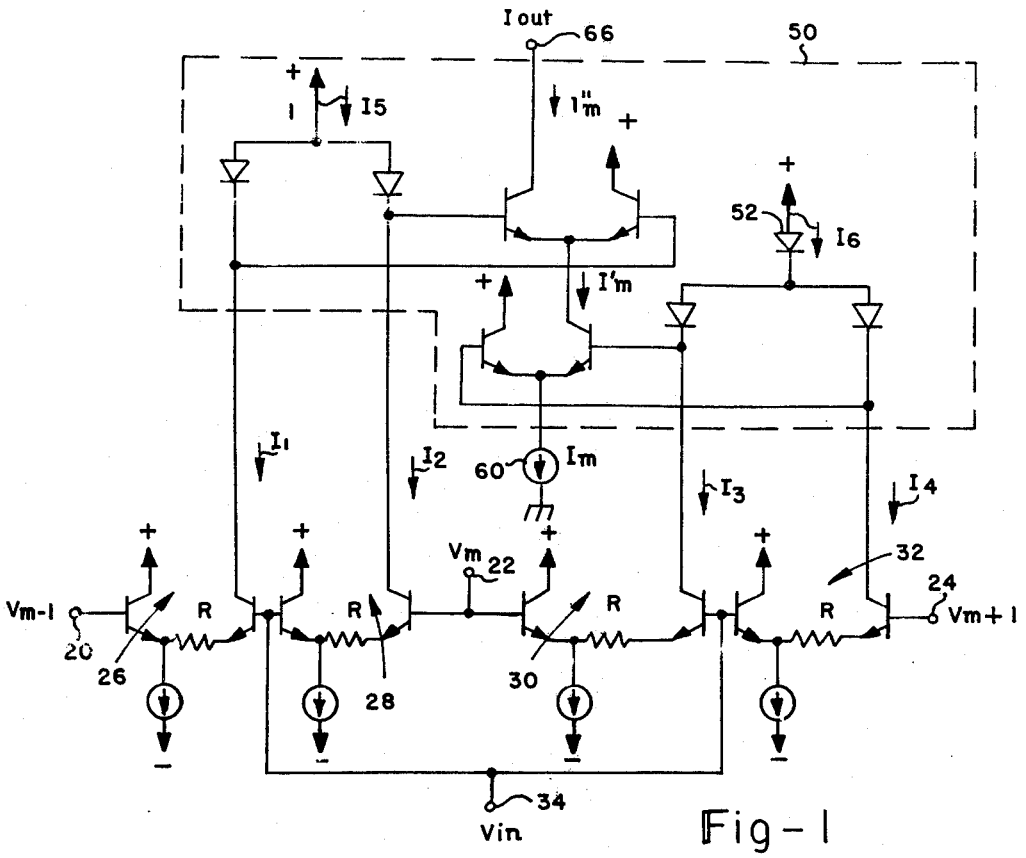
FIG. 1 is a schematic diagram of the basic function generator (elementary cell) according to the present invention.
Figure 2:
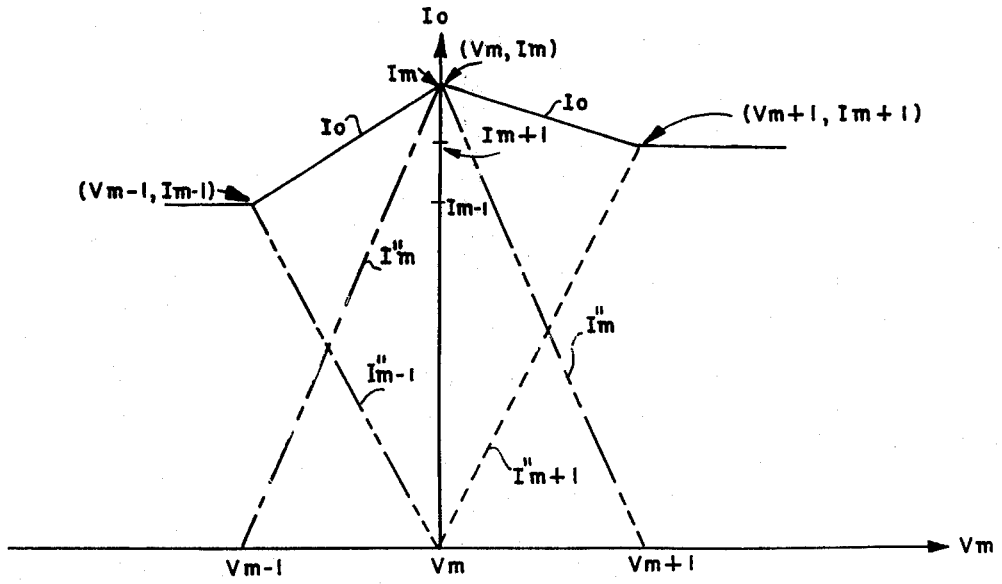
FIG. 2 is a plot of output currents versus input voltages ("transfer curve") for the basic function generator according to FIG. 1.

FIG. 1 illustrates the basic function generator according to the present invention which will be preliminarily discussed in explaining the operation of the present invention. FIG. 2 illustrates the relationships among the voltage and the currents for the basic function generator of FIG. 1. As can be discerned, the basic circuit provides a piecewise linear approximation between, say, breakpoints corresponding to coordinates (Vm−1, Im−1), (Vm, Im), and (Vm+1, Im+1); such piecewise linear approximation being the straight line segments Io joining the mentioned breakpoint coordinates by algebraically adding together the linear approximations given by the straight line segments I'λ 'm−1, I''m and I''m+1. Programmed input voltages, say Vm−1, Vm, Vm+1 etc., monotonically increasing are applied to programmable inputs 20, 22 and 24 respectively. Each input is, in turn, connected to one side of a plurality of differential amplifiers indicated generally by 26, 28, 30 and 32. Each differential amplifier or comparator includes a first transistor whose emitter and collector are referenced to suitable voltage sources such as +5 volts and −5 volts via a series "long tail" current source and a second transistor whose emitter is referenced to the emitter of the first transistor via the resistor R and whose collector serves as an output. The other side of each comparator is connected to an input terminal 34 which is provided for recieving the signal to be linearized, hereinafter referred to as Vin. As can be discerned from FIG. 1, the bases of each transistor pair becomes the input to the comparator. Current for each comparator is determined by the "long tail" current sources.

The output (collector current) of each comparator is applied to a device 50 defining a plurality of wideband differential amplifiers as fully described and detailed in U.S. Pat. No. 3,689,752 which splits the programmed current into two currents having the same relative ratio as the ratio of the difference voltage applied to the comparators. Device 50 will be hereinafter referred to as a Quadrant Multiplier, whilst circuits and components connected substantially as in FIG. 3 of the patent as a "gain cell". The quadrant multiplier of the basic function generator comprises two such gain cells. Common current is supplied to the gain cells by a current source 60 which can be, for example, a properly biased transistor for providing a substantially constant tail current. An additional diode 52 not described in the above mentioned patent is incorporated because two gain cells and only one current source are used (current source 60 supplies tail current to a gain cell, which in turn supplies tail current to another gain cell) and provides a necessary voltage dropped to prevent the saturation of the stacked gain cell. An output 66 is also provided.

Referring again to FIGS. 1 and 2, the basic function generator provides the total output current, Iout, which is the sum of all I''m where I''m is that fraction of Im which goes to the output. Consider the line segments between breakpoints (Vm−1, Im−1), (Vm, Im) and (Vm+1, Im+1). As Vin increases from Vm−1 to Vm, I''m−1 is interpolated linearly from Im−1 to zero while I''m is interpolated linearly from zero to Im. Similarily, as Vin increases from Vm to Vm+1, I''m is interpolated linearly from Iin to zero while I'm+1 is interpolated from zero to Im+1.

The interpolation just described is best understood by considering four different ranges of Vin, namely where 1. Vin < Vm−1
2. Vm−1 < Vin < Vm,
3. Vm < Vin < Vm+1,
4. Vin > Vm+1.

The currents I1 – I6 are easily found using basic circuit analysis and are as follows:

$$I_1 = \frac{Vin - Vm-1}{R},$$

$$I_2 = \frac{Vm - Vin}{R},$$

$$I_3 = \frac{Vin - Vm}{R},$$

$$I_4 = \frac{Vm+1 - Vin}{R},$$

$$I_5 = I_1 + I_2 \quad \text{and}$$

$$I_6 = I_3 + I_4 \quad .$$

When Vin < Vm−1:

$$I_1 = \frac{Vin - Vm - 1}{R} = 0 \text{ and}$$

$$I_2 = \frac{Vm - Vin}{R} \neq 0, \text{ hence}$$

$$I''m = Io = 0.$$

With Vm−1 < Vin < Vm the ration of currents $$I_2 : I_5 = \frac{Vin - Vm - 1}{Vm - Vm - 1}$$

$$\Rightarrow I'm : Im, \text{ since}$$

$$I_3 = \frac{Vin - Vm}{R} = 0 \text{ and}$$

$$I_4 = \frac{Vm + 1 - Vin}{R} \neq 0.$$

Thus the interpolation $$\frac{I''m}{Im} = \frac{Vin - Vm - 1}{Vm - Vm - 1}.$$

When Vm < Vin < Vm+1 the ratio of currents $$I_4 : I_6 = \frac{Vm + 1 - Vin}{Vm + 1 - Vm}$$

$$\Rightarrow I'm : Im. \text{ Since}$$

$$I_2 = \frac{Vm - Vin}{R} = 0 \text{ and}$$

$$I_1 = \frac{Vin - Vm - 1}{R} \neq 0,$$

$$I''m = I'm \text{ and the interpolation}$$

$$\frac{I''m}{Im} = \frac{Vm + 1 - Vin}{Vm + 1 - Vm} \text{ is accomplished.}$$

The fourth position of Vin, where Vin > Vm+1, sets $$I_4 = \frac{Vm + 1 - Vin}{R} = 0 \text{ and}$$

$$I_3 = \frac{Vin - Vm + 1}{R} \neq 0 \text{ so that}$$

$$I'm = I''m = 0.$$

The output Io, becomes the sum of all I''m, where I''m is that fraction of Im which goes to the output.

To those skilled in the art, the extension of the basic function generator as well as an extension of the mathematical analysis to provide the mathematical expectation is easily obtainable. For example, in the particular art already mentioned, faithful signal reproduction is dependent on the quality of the entire system through which the signal is transmitted. The present invention lends itself quite effectively when an interpolation as described is a correction factor which may be used to compensate the entire system. For example, there is shown in FIG. 3 a diagram of a system which employs an extension of the function generator including a plurality of graphs to pictorially illustrate the application.

Figure 3A:
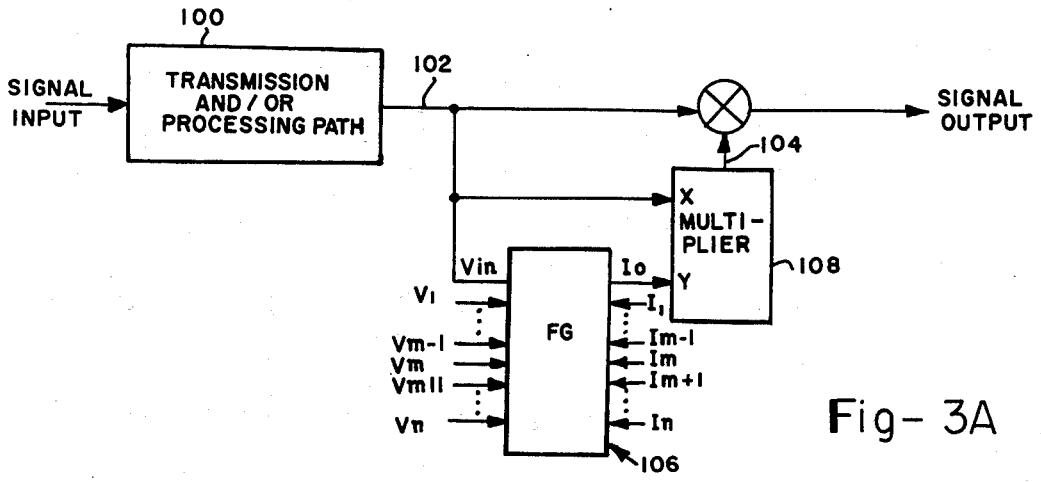
FIGS. 3A–3E is a diagram of one embodiment of the function generator according to the present invention.
Figure 3B:
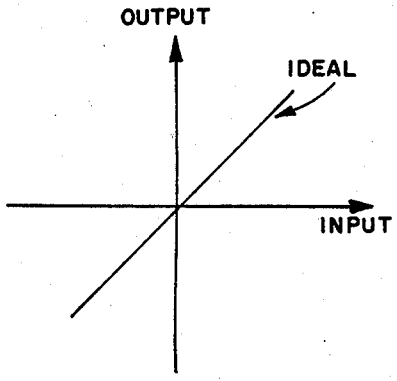
Figure 3C:
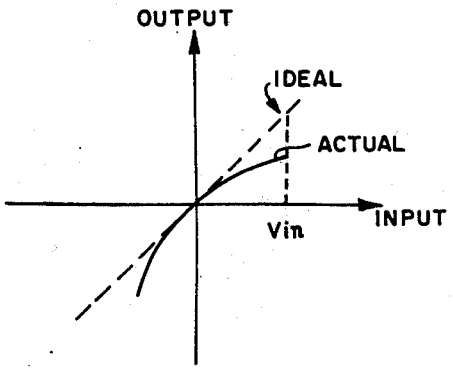
Figure 3D:
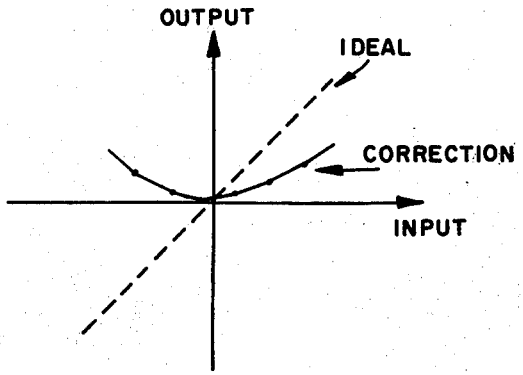
Figure 3E:
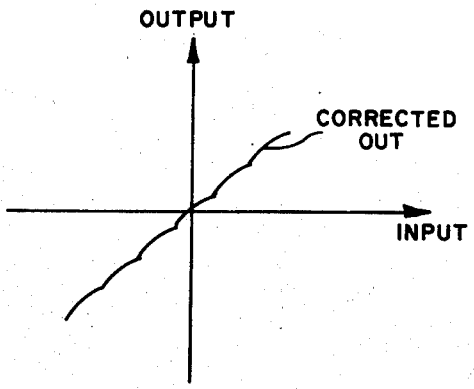

A signal is applied to a transmission and/or signal processing path portion 100, the output of which is generally along the line 102 and is ideally the interpolation shown in FIG. 3B. However, due to non-linearity of the transmission and/or signal processing path 100, the signal output along the line 102 may be, for example, the interpolation shown in FIG. 3C; the distortion due to imperfection of components of the path such as active and passive devices. By simultaneously applying the distorted signal to the Vin input of the subject function generator 106 and to the "X" input of a multiplier 108, and the output (Io) of the function generator 106 to the *y* input of the multiplier, there is produced a correction interpolation, shown in FIG. 3D, along the line 104 which is the product of the *x* and *y* inputs to the multiplier. Adding the correction interpolation to the distorted signal output along the line 102 produces the corrected interpolation shown in FIG. 3E.

While there has been shown and described the preferred embodiment of the present invention it will be apparent to those skilled in the art that many changes and modifications may be made thereon or the use thereof. For example, a plurality of resistors may be used to replace the "long tail" current sources associated with the comparators of FIG. 1. The addition of such resistors over the basic function generator is not intended to be limiting but rather enables amplifier gain to be independent of the impedance of the transistor parameters. Typical values of R and such resistors would be, for example, 250 and 5000 ohms respectively. Additionally, a plurality of impedance means such as resistors may be disposed about the gain cell diodes to compensate the dynamic emitter resistance of the input transistors if nonlinearities occur. A typical value of resistor would be about 3000 ohms. Additionally, in the field of television, faithful picture reproduction is dependent on the quality of the entire video system through which the video waveform is transmitted. This video system is composed of amplifiers, passive elements, etc; the transmission quality usually described in terms of the phase/frequency response and amplitude/frequency response of these system elements. Normally, from time to time there is concern about the operating performance of either specific amplifier or video loops, or the entire video transmission path. The present invention therefore lends itself quite effectively to automatic control of entire transmitter loops. Therefore, the appended claims are intended to cover all such changes and modifications that fall within the true spirit and scope of the invention.

The invention is claimed in accordance with the following:

1. An electronically programmable function generator, comprising:

means including a voltage comparator for generating at least two currents, said currents having a ratio which is the same ratio of voltages applied to said means to generate said currents; and means for combining the ratio of said currents to proportion a reference current as to said ratio of voltages, said proportion being a piecewise linear function.

2. The generator according to claim 1 wherein said means for combining further includes a wideband differential amplifier.

3. The generator according to claim 2 wherein said wideband differential amplifier defines a gain-cell.

4. The method of linearly interpolating an abscissa and ordinate of several points of a non-linear function, comprising:

providing a voltage comparator for generating at least two currents having a ratio which is the same ratio as the ratio of known voltages; and combining the ratio of said two currents to proportion a reference current as to said ratio of known voltages.

* * * * *

UNITED STATES PATENT OFFICE
CERTIFICATE OF CORRECTION

PATENT NO. : 3,982,115

DATED : September 21, 1976

INVENTOR(S) : EINAR ODDBJORN TRAA

It is certified that error appears in the above-identified patent and that said Letters Patent are hereby corrected as shown below:

Column 2, lines 39 and 40 "I'ʎ 'm-1, I"m and I"m+1." should be --I"m-1, I"m and I"m+1.--

Column 3, line 28 "1. Vin < Vm-1" should be --1. Vin < Vm-1,--

Signed and Sealed this

Eighteenth Day of January 1977

[SEAL]

*Attest:*

RUTH C. MASON
*Attesting Officer*

C. MARSHALL DANN
*Commissioner of Patents and Trademarks*